US006508298B2

(12) United States Patent
Vogl et al.

(10) Patent No.: US 6,508,298 B2
(45) Date of Patent: Jan. 21, 2003

(54) METHOD AND APPARATUS FOR PREVENTING UNDESIRABLE COOLING OF THE STRIP EDGE AREAS OF A CAST STRAND

(75) Inventors: Norbert Vogl, Ratingen (DE); Jürgen Friedrich, Mülheim (DE); Hans Streubel, Erkrath (DE); Joachim Schwellenbach, Düsseldorf (DE); Axel Bekurts, Mülheim (DE)

(73) Assignee: SMS Demag AG, Düsseldorf (DE)

( * ) Notice: Subject to any disclaimer, the term of this patent is extended or adjusted under 35 U.S.C. 154(b) by 17 days.

(21) Appl. No.: 09/755,870

(22) Filed: Jan. 5, 2001

(65) Prior Publication Data

US 2001/0020527 A1 Sep. 13, 2001

(30) Foreign Application Priority Data

Jan. 13, 2000 (DE) ..... 100 01 073

(51) Int. Cl.[7] ..... B22D 11/124; B22D 11/22
(52) U.S. Cl. ..... 164/486; 164/455
(58) Field of Search ..... 164/486, 444, 164/443, 455

(56) References Cited

U.S. PATENT DOCUMENTS 3,915,216 A * 10/1975 Fekete et al. ..... 164/455
3,989,093 A * 11/1976 Peitl et al. ..... 164/444

FOREIGN PATENT DOCUMENTS

| | | | |
|---|---|---|---|
| DE | 1289956 | | 2/1969 |
| DE | 1558194 | | 10/1970 |
| DE | 2208928 | | 7/1973 |
| DE | 4425379 | | 1/1996 |
| JP | 07009100 | * | 1/1995 |
| JP | 2000005849 | * | 1/2000 |

OTHER PUBLICATIONS

Patent Abstracts of Japan, vol. 1995, No. 04, May 31, 1995 & JP 07 009100 A (Kawasaki Steel Corp) Jan. 13, 1995.
Patent Abstracts of Japan, vol. 2000, No. 04, Aug. 31, 2000 & JP 2000 005849 A (Showa Electric Wire & Amp), Jan. 11, 2000.

* cited by examiner

*Primary Examiner*—Tom Dunn
*Assistant Examiner*—I.-H. Lin
(74) *Attorney, Agent, or Firm*—Friedrich Kueffner

(57) ABSTRACT

A method and an apparatus for preventing undesirable intensive cooling particularly of the strip edge areas of a cast strand resulting from running water emerging from the bottom opening of a secondary cooling chamber, wherein high-energy spray jets of a deflection medium are produced and directed against the emerging running water transversely of the strip edge areas of the cast strand, such that the running water is deflected from the strip edge areas and is discharged through outlet openings of the secondary cooling chamber arranged on both sides of the cast strand.

4 Claims, 4 Drawing Sheets

METHOD AND APPARATUS FOR PREVENTING UNDESIRABLE COOLING OF THE STRIP EDGE AREAS OF A CAST STRAND

BACKGROUND OF THE INVENTION

1. Field of the Invention

The present invention relates to a method and an apparatus for preventing undesirable cooling particularly at the strip edge areas of a cast strand by means of the running water which emerges from the bottom opening of a secondary cooling chamber.

2. Description of the Related Art

In the operation of continuous casting plants for thin slabs it is known that running water emerges laterally next to the strand where the strand exits the secondary cooling chamber; this causes an undesired intensive undercooling of the strand edges. This effect is intensified as the casting size increases and as the casting speed increases.

In a continuous casting plant according to DE-OS 2 208 928, in which the strand is continuously pulled downwardly out of a water-cooled mold and is guided through a supporting and guiding device with rollers, a portion of the cooling device is formed by fan jet nozzles which are arranged parallel to the surface of the strand, i.e., parallel to the long side of the slab and at a distance therefrom, wherein the longitudinal axis of the cooling device extends parallel to the axes of the rollers. Moreover, in accordance with the known continuous casting plant, the fan jet nozzles are arranged in the area of a slab edge and are preferably arranged at both slab edges opposite each other and offset relative to each other.

In this known continuous casting plant with an arch-shaped supporting and guiding device for guiding the strand from an essentially vertical direction into an essentially horizontal direction, the cooling device is composed of fan jet nozzles in the area of deflection of the strand, i.e., along approximately ⅓ to ⅔ of the length of the supporting and guiding device. In particular, the cooling device is also at the bottom side of the slab composed of fan jet nozzles.

DE-AS 1 558 194 describes a method and an apparatus for cooling a cast strand in a secondary cooling zone. The cast strand is cooled in zones which are offset relative to each other transversely of the strand axis, such that the cooling effects in the zones of adjacent planes supplement each other over the strand surface transversely of the strand axis so as to achieve an approximately uniformly extending cooling effect.

DE-AS 1 289 956 discloses a secondary cooling device for continuous casting products with straight or flat surfaces. This cooling device is composed of a plurality of spray or dispersion nozzles arranged transversely of the strand axis. The spray nozzles have a flat characteristic of the impinging quantity of cooling medium and are arranged at such a distance from each adjacent nozzle that the nozzle sides overlap each other to such an extent that the cooling effect in the overlapping portion deviates only slightly from the cooling effect of the surface portions located outside of the overlapping portions.

None of the devices known in the art include effective means for preventing the running water from emerging laterally next to the strand and the attendant undesirable intensive cooling of the strip edge areas.

SUMMARY OF THE INVENTION

Staring from the prior art discussed above, it is the primary object of the present invention to provide a method and an apparatus for carrying out the method in which the emergence of running water from the secondary cooling chamber of a continuous casting plant laterally next to the strand and the attendant undesirable intensive undercooling of the strip edges are prevented.

In accordance with the present invention, in a method and an apparatus of the above-described type, high-energy spray jets of a deflection medium are produced and are directed preferably transversely of the strip edge areas against the running water outlet, such that the running water is deflected from the strip edge areas and is discharged through outlet openings of the secondary cooling chamber provided on both sides of the cast strand.

The solution according to the present invention of the object described above provides the advantage that an undesirable intensive cooling of the strip edge areas by the running water is suppressed.

By adjusting the process parameters, for example, adjustment of direction, energy content and number and throughput quantity of the individual nozzles, the effectiveness of the method according to the invention is optimized to the required extent and the existing conditions of the strand production of a thin slab casting plant are taken into consideration in an optimum manner.

In accordance with a further development of the method according to the invention, water or air or a water/air mixture are used as the deflect ion medium. This results in an even better adjustment of the process parameters to the existing production condition of a continuous casting plant.

The method according to the present invention further provides that spray jets with flat spray cones are produced. A spray jet of this configuration removes a minimum of heat from the strand, although it cannot be avoided that the deflection medium is also Partially sprayed onto the strand.

In accordance with another further development of the method according to the invention, partially overlapping rows of spraying cones are produced transversely on each side of an edge of the cast strand. This ensures that each side of an edge of the cast strand is completely covered with spray jets of the deflection medium.

In accordance with another further development of the method of the invention, the spray jets are sprayed preferably at an angle a against the travel direction of the running water. As a result, the deflection of the running water is optimized because the nozzles spray upwardly against the direction of flow of the running water.

In accordance with another advantageous embodiment of the invention, the deflection medium is sprayed against the edge areas of the cast strand at a relatively small distance upstream of the bottom opening of the secondary cooling chamber. This results in especially favorable process parameters for the deflection of the running water from the strip edge areas.

In accordance with another embodiment of the invention, several nozzles are arranged in a row so as to extend over the width of the strand, wherein individual pairs of nozzles of the rows of nozzles can be switched on or off depending on the changing width of the strand. This is an uncomplicated and advantageous way to provide changeable zones of strip edge areas to be sprayed transversely of the strand axis depending on the respective width of the strand.

Finally, the invention provides that the spray jets are sprayed essentially perpendicularly relative to the surface of the strip edge areas. This results in an optimum blocking effect of the emerging running water without the long sides of the strand being impinged in an undesired manner by the spray jets so that the strand edges are not subjected to an undesired cooling effect.

An apparatus for preventing an undesirable intensive cooling of the strip edge areas of a cast strand by the running water emerging from the bottom opening of a secondary chamber includes spray nozzles arranged in a row for producing high-energy spray jets directed against the running water outlet, wherein the spray nozzles are arranged at a relatively small distance upstream of the bottom opening of the secondary cooling chamber for the cast strand, and wherein the spray nozzles are combined in rows extending in the direction of the strand width and the spray nozzles are connected individually through throttle means to a feed line.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
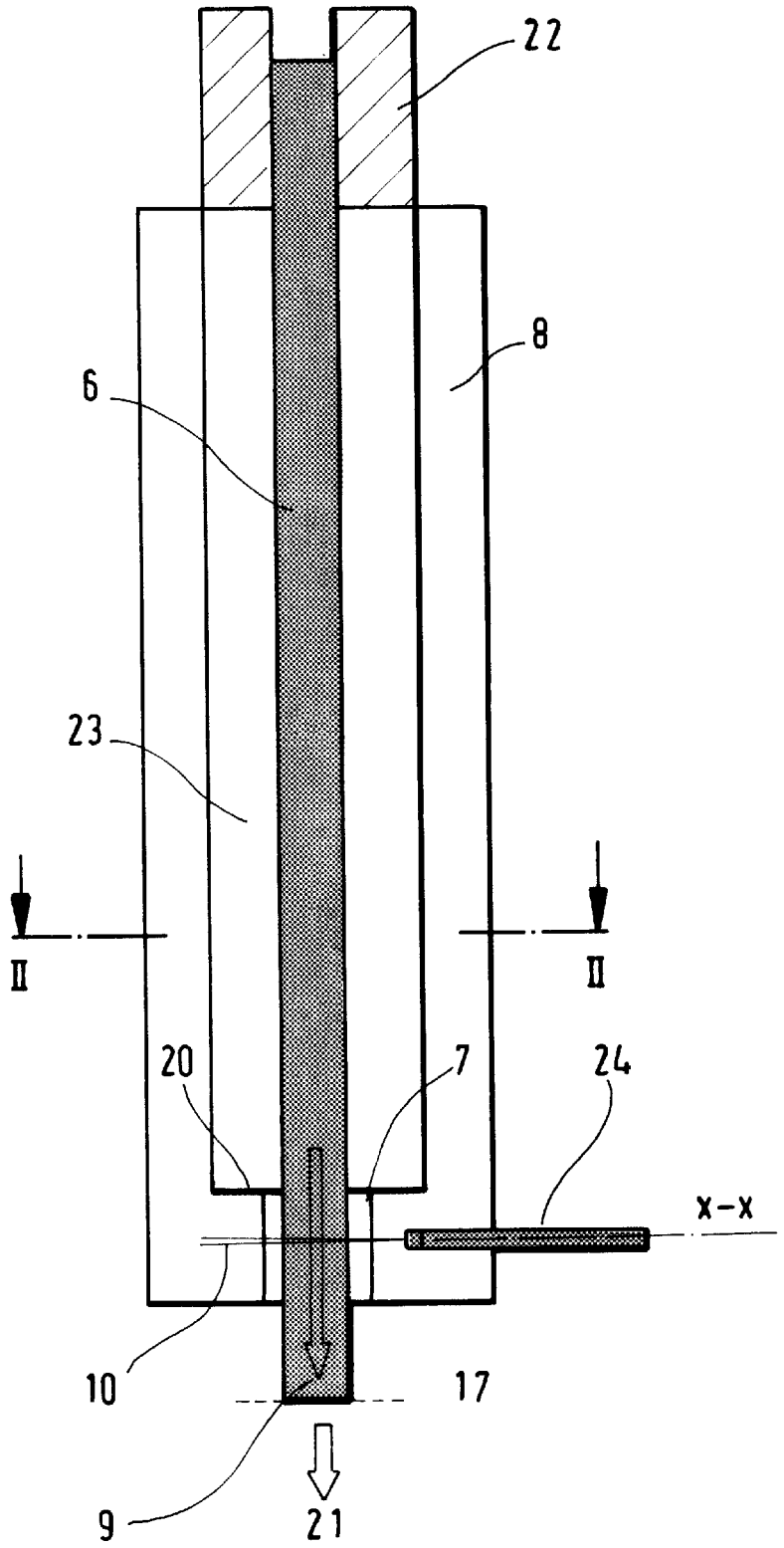
FIG. 1 is a schematic side view of a continuous casting plant with a spray apparatus according to the invention.

The part of a continuous casting plant shown in FIG. 1 of the drawing with means for carrying out the method according to the invention is seen in a side view in such a way that the narrow side of the cast strand 6 is visible.

The schematic illustration of FIG. 1 shows at the top a mold 22 from which a cast strand 6 is pulled downwardly in accordance with the arrow 21. The cast strand 6 travels through a strand guiding device 23 (shown only as a black box), arranged within a secondary cooling chamber 8, also only shown as a black box. The schematic illustration of strand guiding device 23 and cooling chamber 8 without providing structural details was selected for reasons of clarity because it can be assumed that those skilled in the art will be familiar with the structural details of these elements. Provided in the lower portion of the secondary cooling chamber 8 is the bottom 20 thereof with the bottom opening 7 through which the strand 6 together with a flow of running water emerges downwardly. Arranged in the area of this outlet is a supply line 24 for the deflection medium emitted from the spray nozzle 17 in the form of spray jets 10. This deflection medium may be water or air or a water/air mixture.

Figure 2:
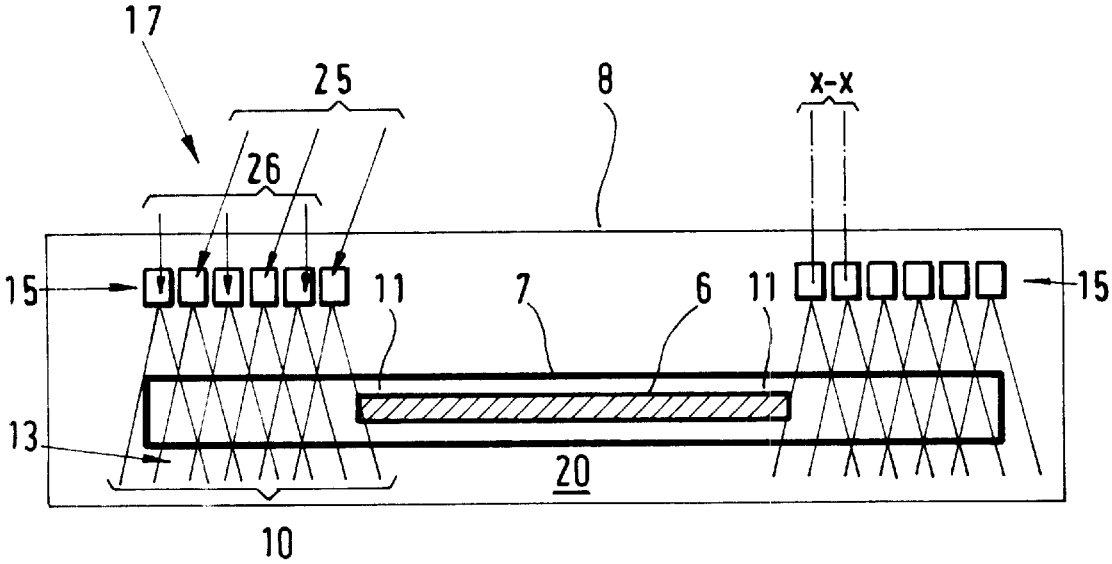
FIG. 2 is a sectional view taken along sectional plane II—II in FIG. 1 in the direction towards a cooling chamber bottom.

As seen in the top view of the cooling chamber bottom 20 shown in FIG. 2, the arrangement of spray nozzles 17 visible next to the bottom opening 7 of the cooling chamber 8 includes an upper nozzle row 25 and a lower nozzle row 26. The individual partially overlapping spray cones 13 produced by the spray jets 10 of the upper and lower nozzle rows are aligned obliquely relative to the travel direction 21 of the cast strand 6 in the area closely above the cooling chamber bottom 20.

This alignment of the rows 15 results in an at least partial overlapping of the spray jets 10 of the upper and lower nozzle rows 25, 26.

Figure 3:
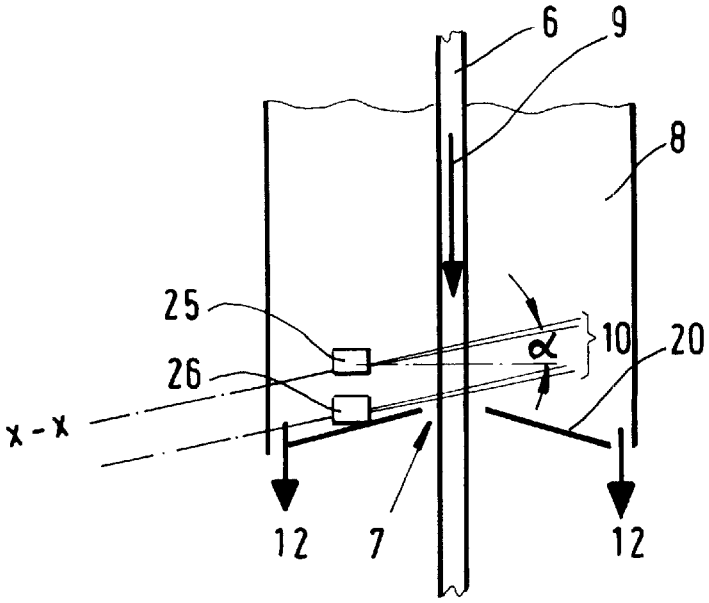
FIG. 3 is a side view of a strand emerging from the cooling chamber with a spray apparatus according to the invention.

As can further be seen in the side view of FIG. 3 in the direction towards the narrow side 16 of a cast strand 6, the spray jets 10 of the upper or lower nozzle rows 25, 26 are aligned at an angle a relative to the travel direction of the running water 9. This results in an optimum deflection of the running water 9.

FIG. 3 of the drawing further shows the cooling chamber bottom 20 which is upwardly inclined towards the cast strand and the bottom opening 7, wherein the bottom opening 7 is open adjacent the strand 6. The purpose of the invention is to particularly prevent running water 9 from flowing through the area of the bottom opening 7. This is achieved by the effect of the high-energy spray jets 10 which impinge on the flow of running water 9 in such a way that the running water is discharged through outlet openings 12 of the secondary cooling chamber 8 arranged on both sides of the cast strand 6.

Figure 4:
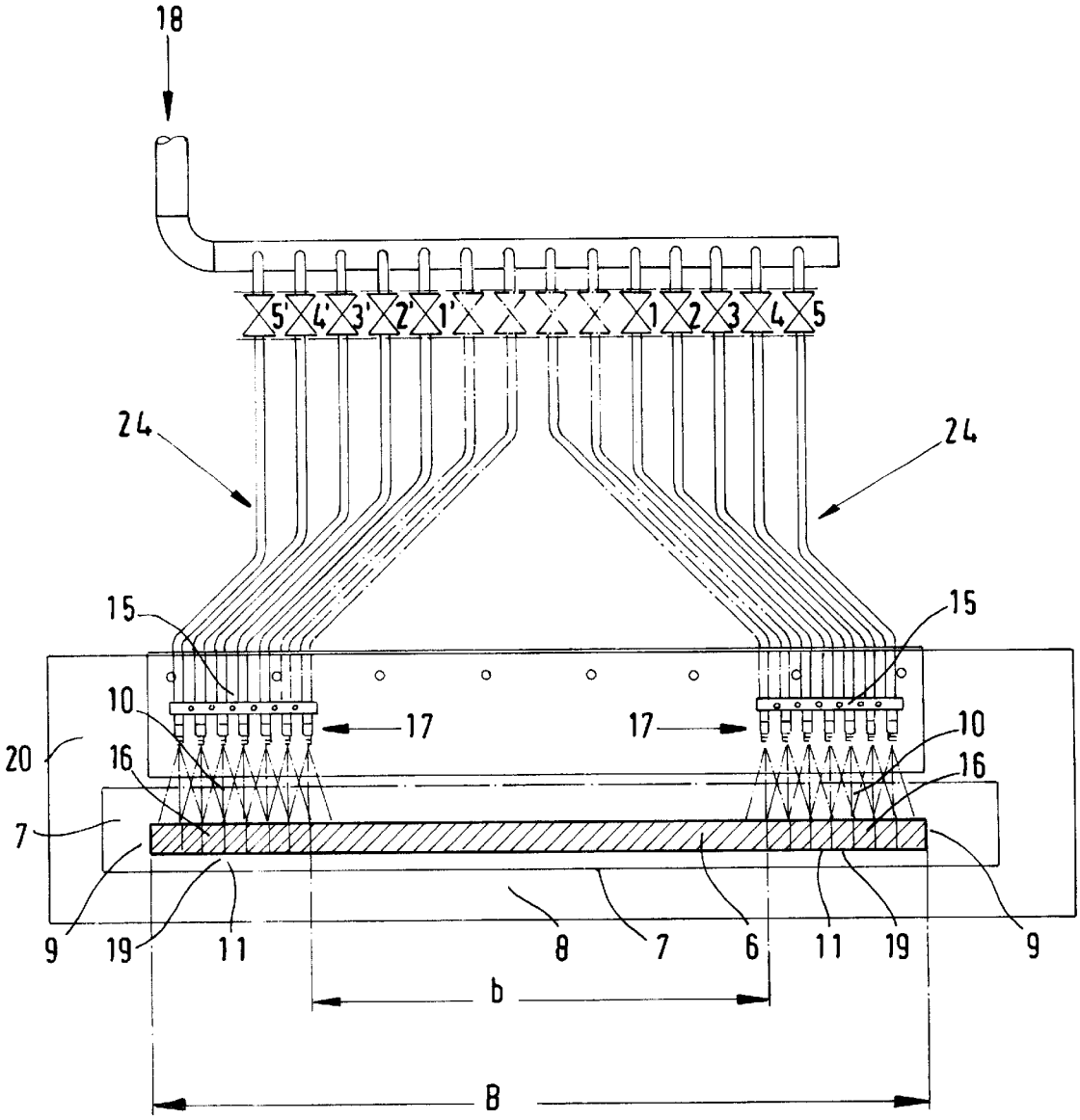
FIG. 4 is a sectional view taken along sectional plane II—II of FIG. 1 showing the cooling chamber bottom with an arrangement of several spray nozzles and the pipe connections thereof.

FIG. 4 is another sectional view of the cooling chamber 8 in the sectional plane II—II of FIG. 1 showing an arrangement of spray nozzles 17 in rows 15 for producing high-energy spray jets 10 at the strip edge areas 11 of the cast strand 6.

The pipe connections of the spray nozzles 17 are formed by supply lines 24 which are individually connected to the side of the nozzle rows 15 to a throttle device 1 to 5 each, wherein these throttle devices 1 to 5, in turn, are connected to a common feed line 18.

FIG. 4 shows in detail that, with an arrangement of nozzles over the width of the strand 6 with several rows of nozzles 15 at the narrow side areas 16 of the strand 6, individual pairs of nozzles 1, 1'; 2, 2'; 3, 3'; etc. of the nozzles rows 15 can be switched on or off in dependence on changing strand widths 19.

For illustrating the different strand widths, FIG. 4 schematically shows the shortest strand with b and the greatest strand with B. In between, the strip edge areas 11 can be adapted in steps to the respective conditions.

Also in FIG. 4, the rows of nozzles are designated with reference numerals 15, the spray jets with 10 and the strip edge areas with 16. Any running water occurring at the narrow sides of the strand 6 is denoted by reference numeral 9. The pipe connections of the supply lines are denoted by reference numeral 24. It can also be seen that some lines 24 are shown in solid lines and other lines 24 are shown in dash-dot lines. The purpose of this is to indicate that pipe lines 24 or spray nozzles 17 can be switched on or off depending on the shorter width b or the greater width B of the cast strand 6.

Finally, FIG. 4 also shows the bottom opening 7 in the cooling chamber bottom 20. Denoted with reference number 17 are the variable width sections of the cast strand 6 which indicate a stepwise change of the strand width.

Figure 5:
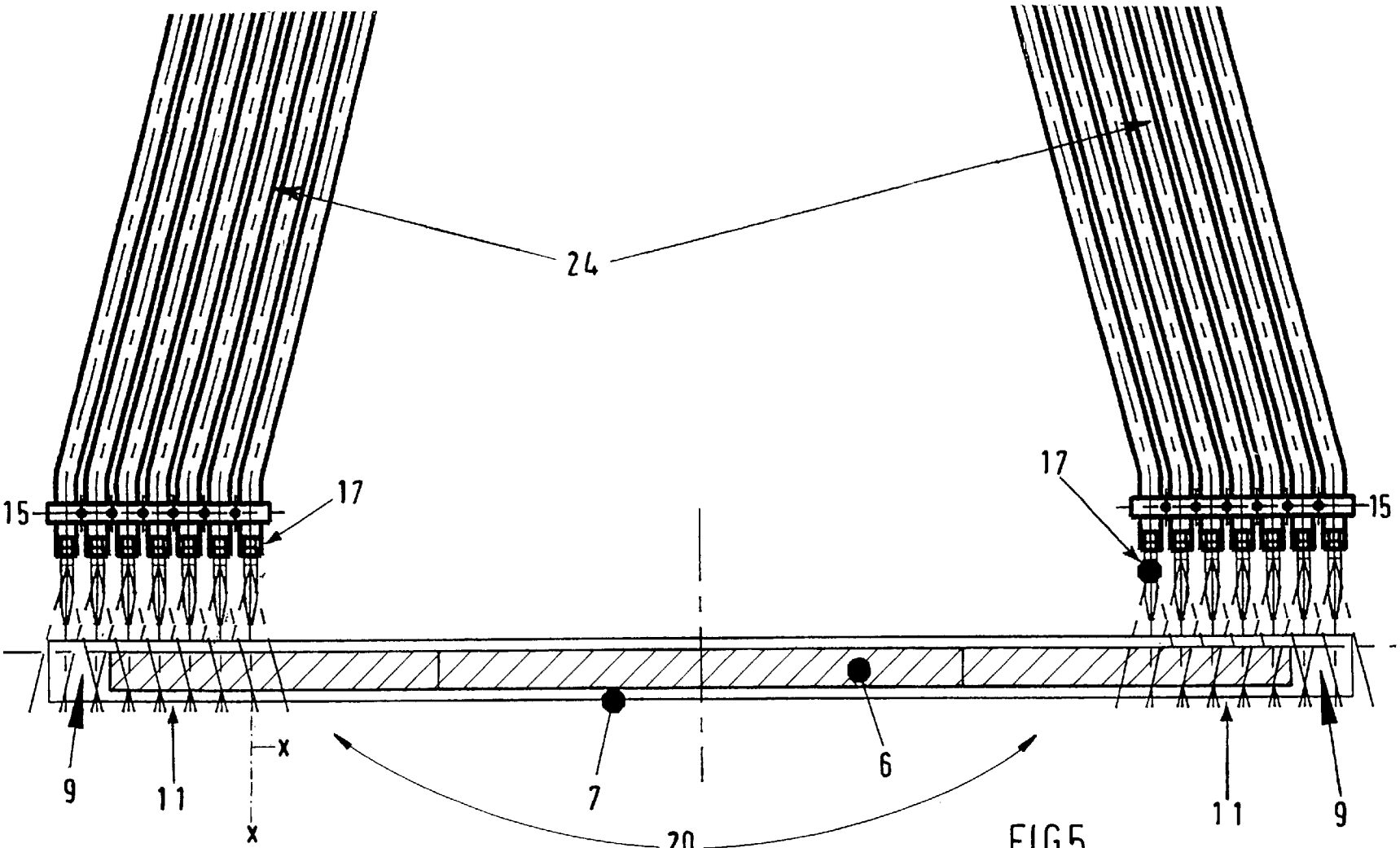
FIG. 5 is a sectional view taken along sectional plane II—II of FIG. 1 showing the cooling chamber bottom with spray nozzles arranged in rows.

FIG. 5 of the drawing is also a top view on a larger scale taken along sectional plane II—II in FIG. 1 showing the structural elements of the apparatus of the present invention, i.e., the strand 6, the bottom chamber 7, the cooling chamber bottom 20, the running water 9 whose discharge is to be prevented in the area of the strip edges 11, as well as the arrangement of nozzle rows 15 with spray nozzles 17. The supply lines to the nozzles 17 are in their totality denoted by reference numeral 24.

While specific embodiments of the invention have been shown and described in detail to illustrate the inventive principles, it will be understood that the invention may be embodied otherwise without departing from such principles.

We claim:

1. A method of preventing in a continuous casting plant for thin slab undesirable cooling of strip edge areas of a cast strand resulting from running water emerging from a bottom opening of a secondary cooling chamber, the method comprising producing with spray nozzles high-energy spray jets of a deflection medium and directing the spray jets transversely of the strip edge areas against the emerging running water such that the running water is deflected from the strip edge areas, and discharging the running water through outlet openings of the secondary cooling chamber located on both sides of the cast strand, further comprising the step of adjusting a direction, an energy content, a number, and a throughput quantity of the spray nozzles taking into consideration existing production conditions of casting the strand, and further comprising the step of using water or air or a water/air mixture as the deflection medium.

2. The method according to claim 1, further comprising the step of producing spray jets with flat spray cones and partially overlapping rows of spray cones transversely of each side of an edge of the cast strand.

3. The method according to claim 1, comprising spraying the spray jets essentially perpendicularly of a strand surface against the strip edge areas.

4. The method according to claim 3, further comprising the step of producing spray jets with flat spray cones and partially overlapping rows of spray cones transversely of each side of an edge of the cast strand.

* * * * *